US012767284B1

(12) United States Patent
Hennessey

(10) Patent No.: US 12,767,284 B1
(45) Date of Patent: Oct. 20, 2026

(54) ANTI-FATIGUE MAT COVERING DEVICE CONFIGURED FOR A BASS BOAT

(71) Applicant: Hennessey Outdoor Electronics LLC, Dayton, TN (US)

(72) Inventor: Brig Anthony Hennessey, Dayton, TN (US)

(73) Assignee: Hennessey Outdoor Electronics LLC, Dayton, TN (US)

( * ) Notice: Subject to any disclaimer, the term of this patent is extended or adjusted under 35 U.S.C. 154(b) by 0 days.

(21) Appl. No.: 19/531,209

(22) Filed: Feb. 5, 2026

(51) Int. Cl.

| | |
|---|---|
| ***B32B 41/00*** | (2006.01) |
| ***B63B 3/48*** | (2006.01) |
| ***B63B 3/68*** | (2006.01) |
| ***B63B 34/00*** | (2020.01) |

(52) U.S. Cl.
CPC ..... *B63B 34/05* (2020.02); *B63B 3/48* (2013.01); *B63B 3/68* (2013.01)

(58) Field of Classification Search
CPC ..... B63B 34/05; B63B 3/48; B63B 3/68
USPC ..... 156/60, 64, 350, 351, 378, 379
See application file for complete search history.

(56) References Cited

U.S. PATENT DOCUMENTS

2006/0228537 A1* 10/2006 Cheung ..... B32B 27/065 428/318.4
2013/0280475 A1* 10/2013 Champion ..... B63B 3/68 29/428
2024/0116601 A1* 4/2024 Brenner ..... B63B 5/24

* cited by examiner

*Primary Examiner* — Michael N Orlando
*Assistant Examiner* — Joshel Rivera
(74) *Attorney, Agent, or Firm* — Richard T. Ogawa; Ogawa P.C.

(57) ABSTRACT

In an example, the present invention provides an anti-fatigue material comprised of, e.g., a 15 mm, closed cell foam pad configured with, e.g., a 6 mm, closed cell EVA foam pad laminated together and cut for an exact fit to a spatial deck of a boat. In an example, combining those two types of materials together and adhering it to the surface with the adhesive backed 15 mm foam provides the user with stability from the 6 mm foam and cushion from the 15 mm foam so a user or fisherman (or woman) can stand on it longer without getting fatigued whether the man or woman uses footwear or not.

12 Claims, 11 Drawing Sheets

BOTTOM VIEW

DETAIL A
SCALE 1 : 1

SIDE VIEW

DETAIL C
SCALE 1 : 1

RIGHT VIEW

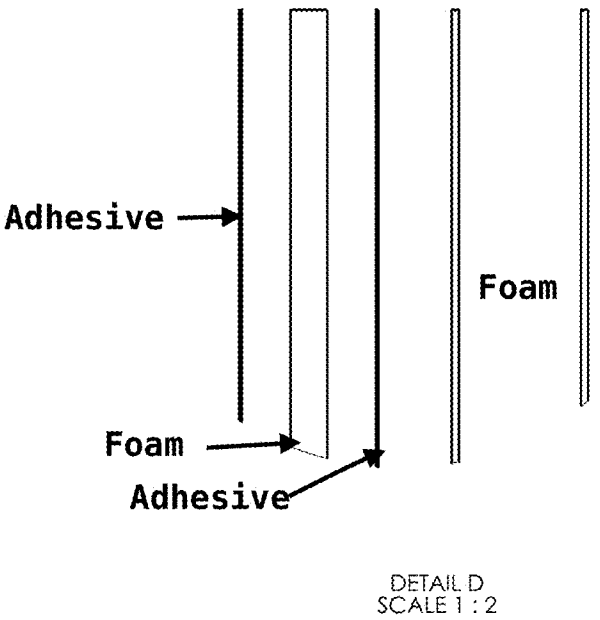
Figure 6
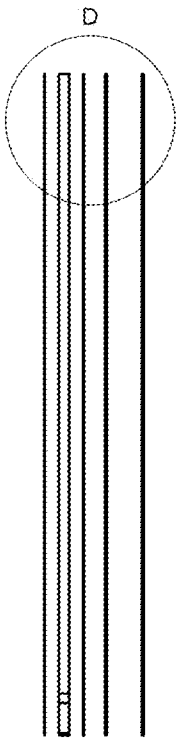
RIGHT VIEW EXPANDED

ISOMETRIC VIEW

ISOMETRIC VIEW EXPANDED

ANTI-FATIGUE MAT COVERING DEVICE CONFIGURED FOR A BASS BOAT

BACKGROUND OF INVENTION

Modern bass boats are commonly equipped with carpeted decks, particularly in areas where anglers stand for extended periods while fishing. Carpet has historically been used due to its low cost, ease of installation, and ability to reduce glare and noise. While carpeted decks have become an industry standard, they present several significant drawbacks that negatively affect user comfort, durability, and overall fishing performance.

For example, a major drawback of carpeted boat decks is their susceptibility to wear and tear. Carpet fibers degrade over time due to repeated foot traffic, exposure to water, fish slime, hooks, and environmental elements such as sun and heat. As the carpet wears, it can become matted, frayed, or torn, diminishing both its appearance and functionality. Additionally, carpet tends to retain moisture, which can lead to unpleasant odors, mold, mildew, and accelerated material breakdown.

Another significant drawback of carpeted decks is their inherent hardness and lack of ergonomic support. Beneath the carpet, bass boat decks are typically constructed of rigid materials such as fiberglass or aluminum. The carpet itself provides little to no cushioning, shock absorption, or pressure relief. As a result, anglers who stand on these decks for long durations experience increased fatigue and physical strain.

This drawback is further exacerbated by the fact that anglers often fish barefoot or without traditional footwear. Even when shoes are worn, they are often lightweight fishing shoes or casual footwear that are not designed to provide sufficient cushioning or support for standing for hours at a time. Prolonged standing on hard, carpeted surfaces can lead to discomfort and pain in the feet, legs, knees, and lower back, reducing endurance and overall enjoyment of the fishing experience.

Given these limitations, anglers are frequently forced to take breaks, leave the water earlier than desired, or endure ongoing physical discomfort. Consequently, conventional carpeted deck surfaces fail to adequately support anglers who wish to remain on the water for extended periods and fish more effectively.

Accordingly, there exists a need for an improved deck surface solution that overcomes the shortcomings of traditional carpeted bass boat decks.

SUMMARY OF INVENTION

According to the present invention, techniques related generally to a flooring covering a deck of a fishing boat are provided. In particular, the present invention provides a flooring device and related methods. Merely by way of example, the invention can be applied to a variety of applications, including a bass boat, a ski boat, a houseboat, and other commercial and recreational systems and methods.

In an example, the present invention provides an anti-fatigue material comprised of, e.g., a 15 mm, closed cell foam pad configured with, e.g., a 6 mm, closed cell EVA foam pad laminated together and cut for an exact fit to a spatial deck of a boat. In an example, combining those two types of materials together and adhering it to the surface with the adhesive backed 15 mm foam provides the user with stability from the 6 mm foam and cushion from the 15 mm foam so a user or fisherman (or woman) can stand on it longer without getting fatigued whether the man or woman uses footwear or not.

In an example, the present technique provides various benefits and/or advantages. In an example, the present mat device prevents water absorption by the underlying carpet, thereby eliminating excess moisture retention and avoiding additional weight accumulation in the bow section of the boat. Preferably, such mat device is particularly desirable during adverse weather conditions, as the low or no water absorption reduces the risk of exceeding the vessel's safe load capacity due to water uptake. Unlike some manufacturers' designs that lack padding beneath the forward deck carpet, the present device incorporates, e.g., a 21 mm closed-cell foam layer, of padding positioned between the user and a carpeted deck surface. In an example, the padding provides enhanced shock absorption and load distribution, resulting in increased standing comfort and reduced fatigue in the feet, legs, and lower back during prolonged use.

In cold weather conditions, the mat offers improved traction compared to wet or frozen carpeted surfaces. The material is engineered to repel water rather than absorb it, allowing water to bead and shed efficiently and preventing moisture retention within the mat structure.

Additionally, the mat device serves as a protective barrier for the underlying carpet, reducing wear and abrasion over time. Upon removal, the carpet surface remains in like-new condition, with no adhesive residue or surface degradation.

Thermally, the mat exhibits lower heat retention than traditional carpet during summer conditions, contributing to improved user comfort by reducing surface temperatures.

In an example, the present device is water resistant.

These and other benefits and/or advantages are described throughout the present specification and more particularly below.

The above examples and implementations are not necessarily inclusive or exclusive of each other and may be combined in any manner that is non-conflicting and otherwise possible, whether they be presented in association with a same, or a different, embodiment or example or implementation. The description of one embodiment or implementation is not intended to be limiting with respect to other embodiments and/or implementations. Also, any one or more function, step, operation, or technique described elsewhere in this specification may, in alternative implementations, be combined with any one or more function, step, operation, or technique described in the summary. Thus, the above examples implementations are illustrative, rather than limiting.

A further understanding of the nature and advantages of the invention may be realized by reference to the latter portions of the specification and attached drawings.

BRIEF DESCRIPTION OF THE DRAWINGS

In order to more fully understand the present invention, reference is made to the accompanying drawings. Understanding that these drawings are not to be considered limitations in the scope of the invention, the presently described embodiments and the presently understood best mode of the invention are described with additional detail through use of the accompanying drawings in which:

FIGS. 5 and 6 are simplified right view diagrams of a covering article according to an example of the present invention.

DETAILED DESCRIPTION OF THE EXAMPLES

Figure 1:
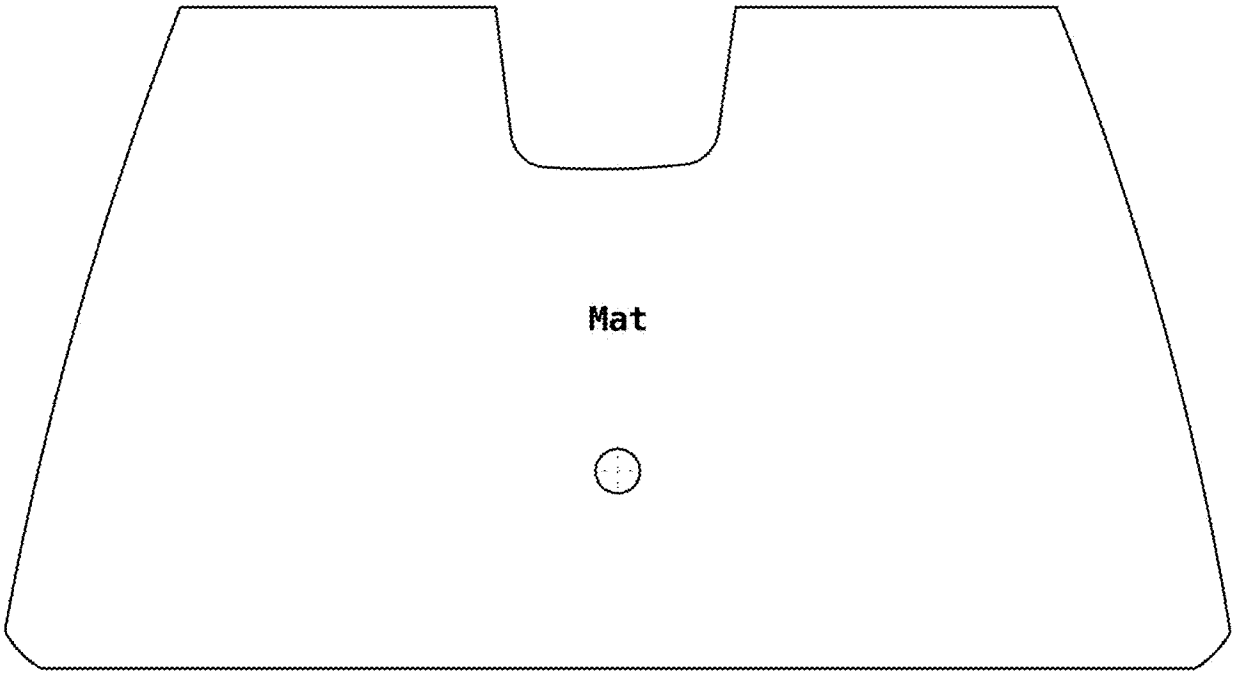
FIG. 1 is a simplified top view diagram of a covering article (e.g., mat) according to an example of the present invention.

According to the present invention, techniques related generally to a flooring covering a deck of a fishing boat are provided. In particular, the present invention provides a flooring device and related methods. Merely by way of example, the invention can be applied to a variety of applications, including a bass boat, a ski boat, a house or pontoon boat, and other commercial and recreational systems and methods.

As further noted, there is a need for a mat or deck covering that provides enhanced comfort, cushioning, and ergonomic support, reduces physical strain on the user's feet, legs, knees, and back, and allows anglers to stand comfortably for longer periods. Such a mat or deck covering would improve user endurance, comfort, and overall fishing performance while addressing the durability and comfort limitations of conventional carpeted decks.

In an example, I made a novel mat to solve the issue of fatigue being on the water all day, standing at the front of the boat fishing. No two manufacturers build their boats the same, that is, some manufacturers have padding under their carpet up front, some manufacturers do not have padding. In an example, some manufacturers use 24 oz carpet, others use 28 oz carpet, while other manufacturers do not use carpet at all. In a preferred example, I wanted to ensure that the present mat device, method, and techniques could level the playing field for fishing boats by putting a high-quality mat that would be comfortable, grips better, and looks like it came from the factory, rather than low quality aftermarket versions.

In an example, the present device, method, and techniques include custom embossing various names and logos on surfaces of the mat device. As background, professional anglers use their boats as a billboard with sponsor stickers all over them including on their carpet. The stickers placed on the carpet leave a lasting residue and when pulled off after a season in the sun leave a mark where the sticker was placed because the UV rays from the sun did not penetrate thru the sticker affectively leaving a shadow of where the sticker was. In an preferred example, the present techniques can cut the sponsors' names or logo into the mat material, so stickers are not laid onto the surface anymore. In an example, the present techniques allow for simply removing the mat before selling the boat, and the carpet looks new.

In a preferred example, the present mat device includes an (e.g., 15 mm) adhesive backed foam and a (e.g., 6 mm) closed-cell (ethylene-vinyl acetate) EVA waterproof foam that are laminated together using a novel technique. In an example, the adhesive on the 15 mm foam adheres to underlying materials such as, for example, carpet, fiberglass, gelcoat, metal, and like materials forming an adhesive bond allowing it to stick and stay down on such materials. In an example, the 6 mm EVA foam is more dense giving rigidity and structure to the top of the mat. Further details of the present techniques are found throughout the present specification and more particularly below.

In an example, the present invention provides a technique for fabricating an article as a covering or mat as shown below, and referring to the Figures.

1. Provide a sheet of first 3 mm EVA thickness of foam material;
2. Provide a sheet of second 3 mm EVA thickness of foam material;
3. Bond the sheet of first 3 mm EVA thickness of foam material to the sheet of second 3 mm EVA thickness of foam material with an adhesive material (e.g., 3M adhesive 3M-9775WL) between them;
4. Apply 50-150 KPa of pressure between the first EVA thickness of foam material and the second EVA thickness of foam material to form a first sheet of 6 mm EVA laminated material;
5. Output the first sheet of 6 mm EVA laminated material comprising the first thickness of foam material and the second thickness of foam material;
6. Provide a sheet of, e.g., 15 mm closed cell foam (e.g., High Tech Foam Products LLC, Indianapolis, Indiana, Part #VEVA3B), having a first side and a second side, the first side having an overlying adhesive material (e.g., Avery Dennison adhesive Part No. FT 1126);
7. Bond the second side of the sheet of 15 mm closed cell foam to the first sheet of 6 mm laminated material using an adhesive material (e.g., 3M adhesive 3M-9775WL);
8. Output a sheet of 21 mm thickness laminated material;
9. Subject the 21 mm thickness laminated material to a temperature ranging from 160 Celsius to 170 Celsius for between, e.g., 1890 and 2310 minutes, to cure the adhesive material;
10. Remove the sheet of 21 mm laminated material;
11. Shape the sheet of 21 mm laminated material using a laser cutting or mechanical cutting process for customization to a spatial region of a boat in an example create separate mats;
12. Clean spatial region (e.g., deck) of boat of debris by vacuum and/or carpet cleaner and dry if using carpet cleaner before installation of the laminated material;
13. Peel covering for the adhesive backing on the laminated material and apply laminated material directly to carpet or fiberglass;
14. Smooth laminated material by rolling an object such as a carpet roller on exposed surfaces of the laminated material to ensure proper adhesive bonding to form a covering of the deck or other spatial region of the boat;
15. Subject the covering to the environment including rain, snow, heat, moisture, mechanical forces, fish, chemicals, and others for the boat, while the region underlying the covering remains protected and free from moisture; and
16. Optionally, remove the covering to expose the carpet, which is still in a new and unused state in an example.

In an example, the above sequence of steps can be modified, expanded, replaced, without departing from the claims of the invention. Further details of the present technique can be found throughout the present specification.

In an example, the present invention provides a method for manufacturing and an anti-fatigue surface for a bass boat or other vessel. In an example, the method includes providing a first sheet of Ethylene Vinyl Acetate (EVA) foam material having a first surface region and a second surface region opposing the first surface region and a thickness sandwiched between the first surface region and the second surface region. In an example, the first sheet of EVA foam material has a gray color or others.

In an example, the method includes providing a second sheet of EVA foam material having a first surface region and a second surface region opposing the first surface region and a thickness sandwiched between the first surface region and the second surface region. In an example, the second sheet of EVA foam material has a color selected from any combination of red, green, and blue or black, among others.

In an example, the method includes coupling the first sheet of EVA foam material with the second sheet of EVA foam material by bonding the first surface region of the first sheet of EVA foam material with the first surface region of the second EVA foam material using an adhesive material (e.g., 3M adhesive 3M-9775WL) between the first surface region of the first sheet of EVA foam material and the second surface region of the second EVA foam material.

In an example, the method includes subjecting the first sheet of EVA foam material and the second sheet of EVA foam material with a pressure ranging from 50-150 Kpa to form a sheet of laminated EVA material comprising the first thickness of foam material and the second thickness of foam material such that the sheet of laminated EVA material is characterized by a first density.

In an example, the method includes providing a third sheet of closed cell foam (e.g., High Tech Foam Products LLC, Indianapolis, Indiana, Part #VEVA3B) having a first side and a second side, the first side having an overlying adhesive material (e.g., Avery Dennison adhesive Part No. FT 1126-Covering and can peel off).

In an example, the third sheet of closed cell foam being characterized by a second density that is lower in value than the first density and characterized by a black color or others.

In an example, the method includes bonding the second side of the third sheet of closed cell foam to a first surface region of first laminated EVA material using an adhesive material (e.g., 3M adhesive 3M-9775WL) applied to the second side of the third sheet of the closed cell foam.

In an example, the method includes outputting a second sheet laminated material comprising the third sheet of closed cell foam and the sheet of laminated EVA material such that the second sheet of EVA foam material is sandwiched between the first sheet of EVA foam material and the third sheet of closed cell foam.

In an example, the method includes subjecting the second sheet of laminated material to a temperature ranging, e.g., from 160 Celsius to 170 Celsius for between, e.g., 1890 and 2310 minutes to cure the adhesive material in the second laminated material.

In an example, the method includes outputting the sheet of second laminated material characterized by the lower density third sheet of closed cell foam as a bottom region and the first sheet of EVA material as an upper region.

Preferably, the color of the second sheet of EVA material is visible from the upper region to highlight the color of the bass boat or vessel.

In an example, the method includes retrieving an image of a spatial region of a deck of a boat and shaping the second sheet of laminated material using a laser cutting or mechanical cutting process for customization to the spatial region of the bass boat.

In an example, the method includes cleaning a surface region of an entirety of a deck of the bass boat. In an example, the method includes cleaning a surface region of an entirety of a deck of a bass boat using a vacuum cleaner and a surfactant to remove debris from a carpet of the bass boat.

In an example, I discovered that the Avery Denison adhesive FT1126 exhibits excellent adhesion to low surface energy materials, including the 15 mm low-density material and carpet, simultaneously. The adhesive provides sufficient bonding strength to secure the carpet while allowing removal when necessary. Furthermore, the FT116 adhesive remains attached to the foam upon removal and leaves minimal residue on the carpet, facilitating ease of cleaning. The adhesive can be used to bond the laminated material to the carpet and be used extensively in outdoor weather, and then be peeled off without substantial residue on the surface of the carpet In an example, the method includes peeling an adhesive backing of an adhesive material on the bottom region of the second laminated material.

In an example, the method includes subjecting the upper region of the second sheet of laminated using a roller to apply force to the second sheet of laminated material to bond the second sheet of laminated material to the surface region of the deck of the bass boat.

In an example, the first sheet of EVA material has a thickness of three milli-meters and the second sheet of EVA material has a thickness of three millimeters.

In an example, the first density is greater than the second density.

In an example, the second laminated material is operable within a temperature range from 20 Degrees Fahrenheit to 110 (or 120) Degrees Fahrenheit; and is capable of gripping when subjected to moisture or water.

In an example, the second laminated material is capable of gripping a bottom of a foot or shoe while the upper region is subject to moisture or water.

In an example, the sheet of second laminated material is operable in a temperature ranging from, e.g., 20 Degrees Fahrenheit to 110 (or 120) Degrees Fahrenheit.

In an example, the method includes drying the first sheet of EVA foam material using a dryer; and drying the second sheet of EVA foam material using a dryer before coupling the first sheet of EVA foam material to the second sheet of EVA foam material.

In an example, the method preferably includes peeling the article off the carpet of a bass boat where the carpet is free from residue and looks essentially new after a year of use by a pro angler.

Further details of the present invention can be found throughout the present specification and more particularly below.

FIG. 1 is a simplified top view diagram of a covering article according to an example of the present invention. As shown, the covering article is continue laminated material of high density and low density foam material. As shown, the top view diagram illustrates a shaped article to be configured onto a surface area of a bass boat. The shaped article has an opening for a seat post, and cutout for the front portion of a bass boat.

Figure 2:
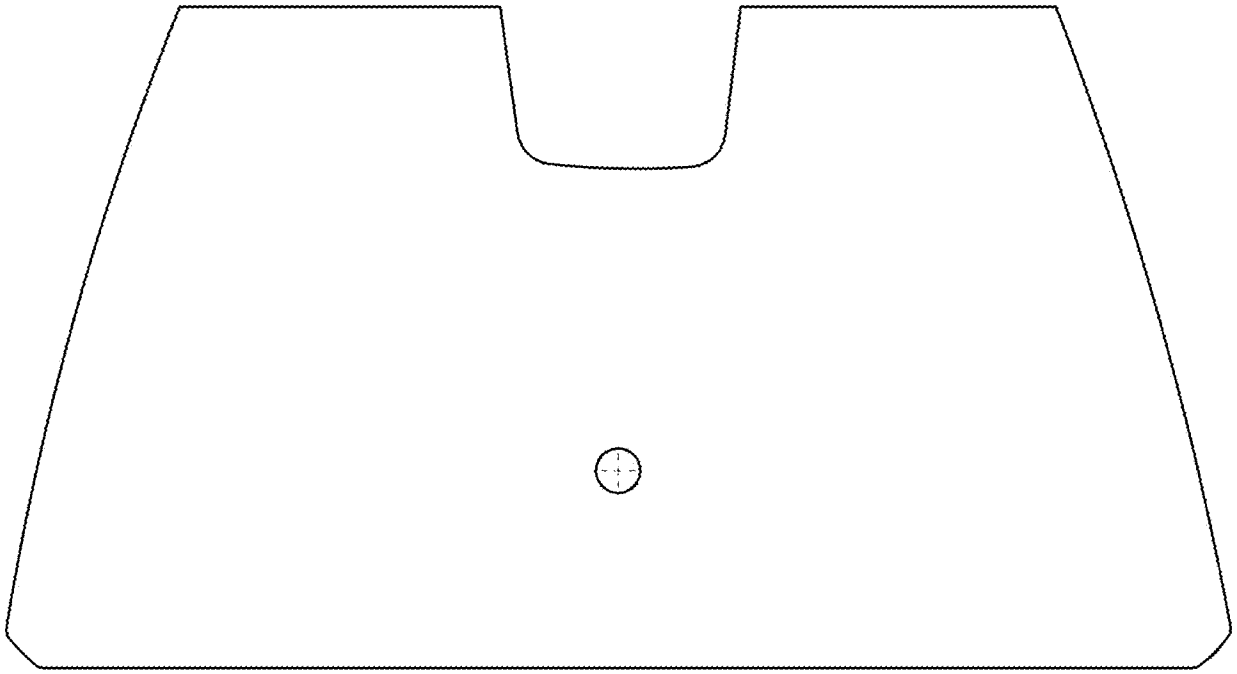
FIG. 2 is a simplified bottom view diagram of a covering article according to an example of the present invention.

FIG. 2 is a simplified bottom view diagram of a covering article according to an example of the present invention. As shown, the covering article is continue laminated material of high density and low density foam material. As shown, the bottom view diagram illustrates a shaped article to be configured onto a surface area of a bass boat.

Figure 3:
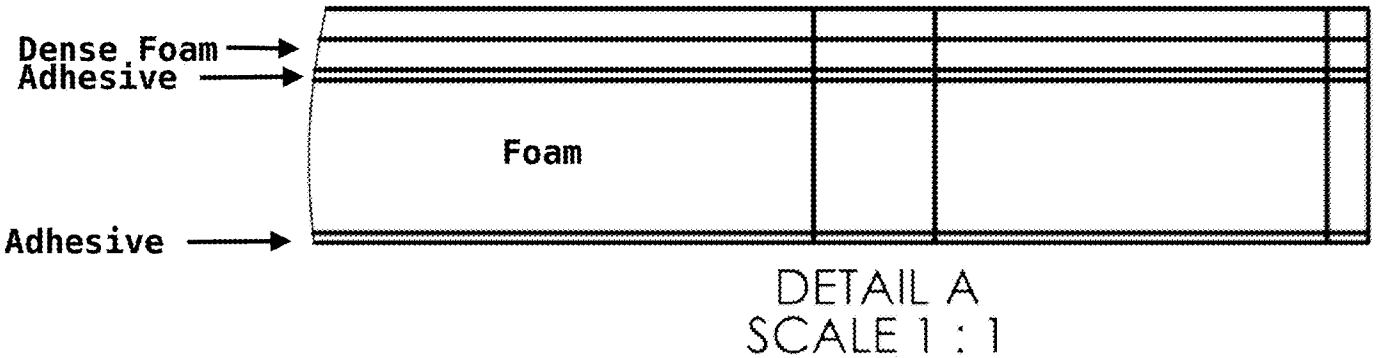
FIG. 3 is a simplified side view diagram of a covering article according to an example of the present invention.
Figure 3:
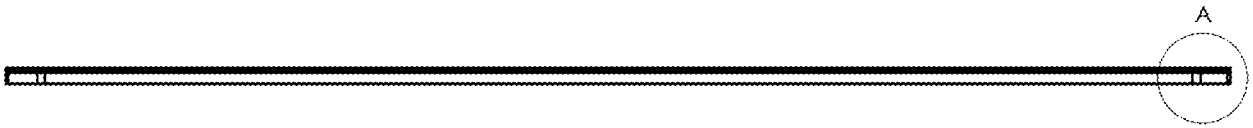

FIG. 3 is a simplified side view diagram of a covering article according to an example of the present invention. As shown is the side view diagram of the covering article, including bottom adhesive material, lower density foam material, an interface of adhesive material and a pair of higher density foam materials. From the upper surface, the covering has two high density sheets stacked together, and an underlying adhesive material, which attaches to a thicker lower density foam. The bottom has an adhesive material with a cover to be moved for attachment to a surface of a boat.

Figure 4:
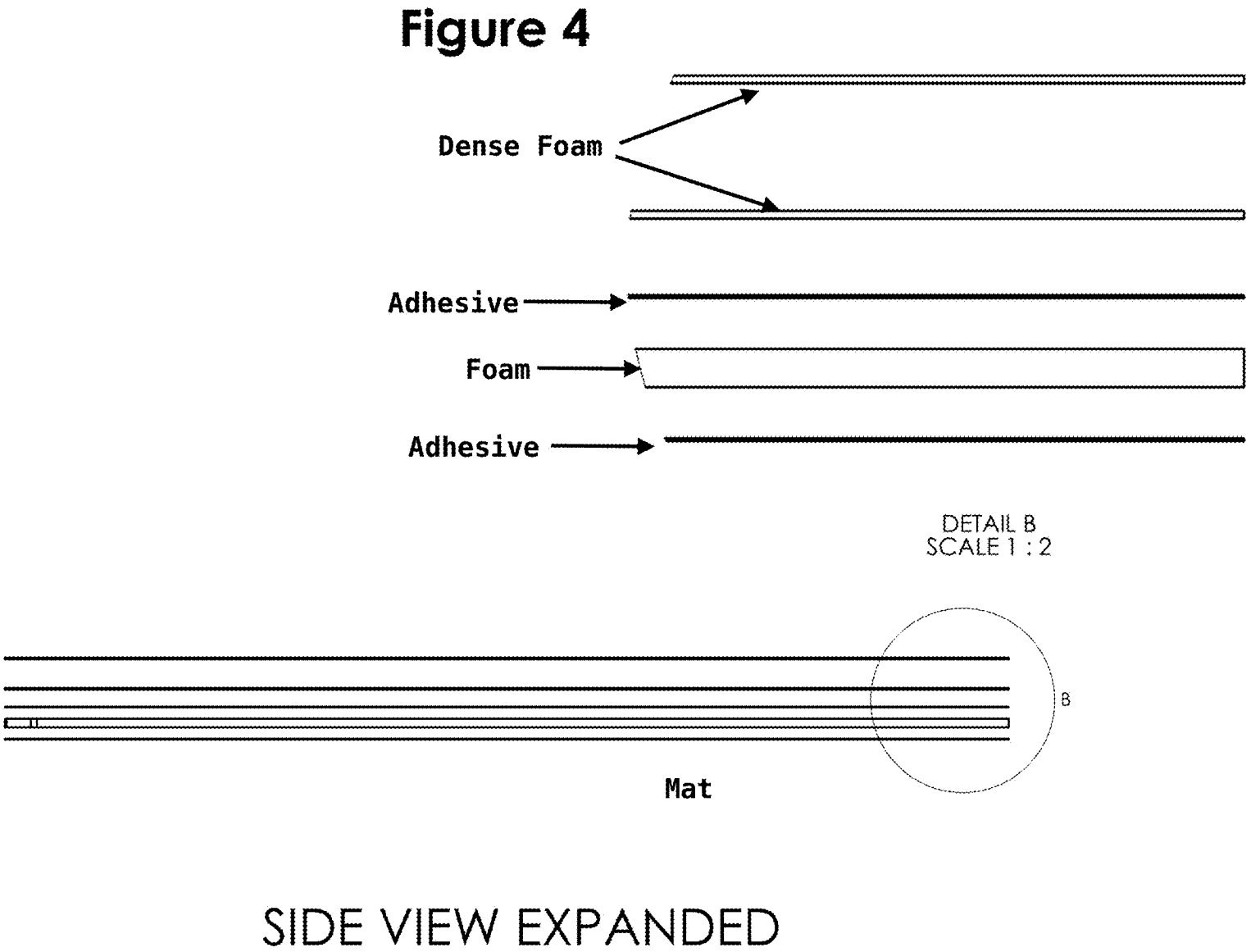
FIG. 4 is a simplified expanded view diagram of a covering article according to an example of the present invention.

FIG. 4 is a simplified expanded view diagram of a covering article according to an example of the present invention. As shown is the side view diagram of the covering article, including bottom adhesive material, lower density foam material, an interface of adhesive material and a pair of higher density foam materials. As shown, the diagram has two dense foam sheets, an adhesive material, and a lower density material. The back surface has an adhesive with a covering.

Figure 5:
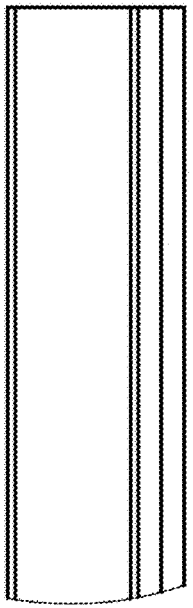
Figure 5:
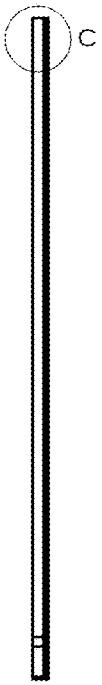

FIGS. 5 and 6 are simplified right view diagrams of a covering article according to an example of the present invention. As shown is the right view diagram of the covering article with the sheet of laminated material, and an expanded view.

Figure 7:
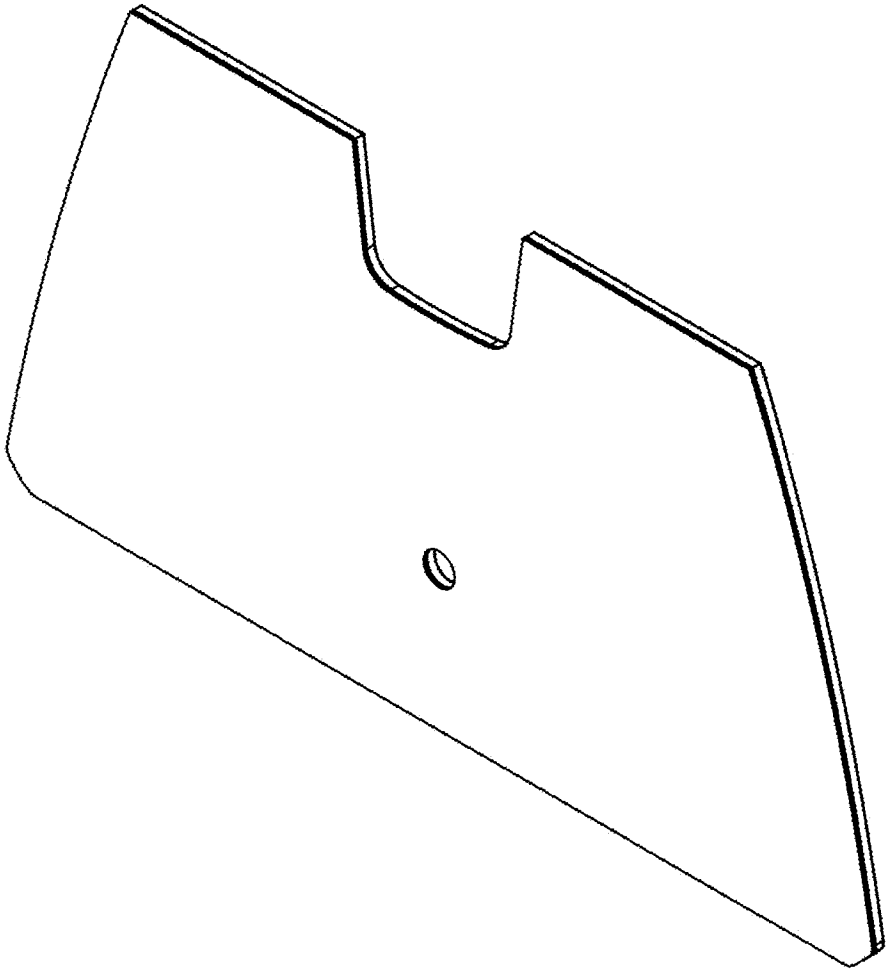
FIG. 7 is a simplified isometric view diagram of a covering article according to an example of the present invention.

FIG. 7 is a simplified isometric view diagram of a covering article according to an example of the present invention. As shown is the right view diagram of the covering article with the sheet of laminated material. In an example, the sheets are stacked and configured together to form a continuous structure.

Figure 8:
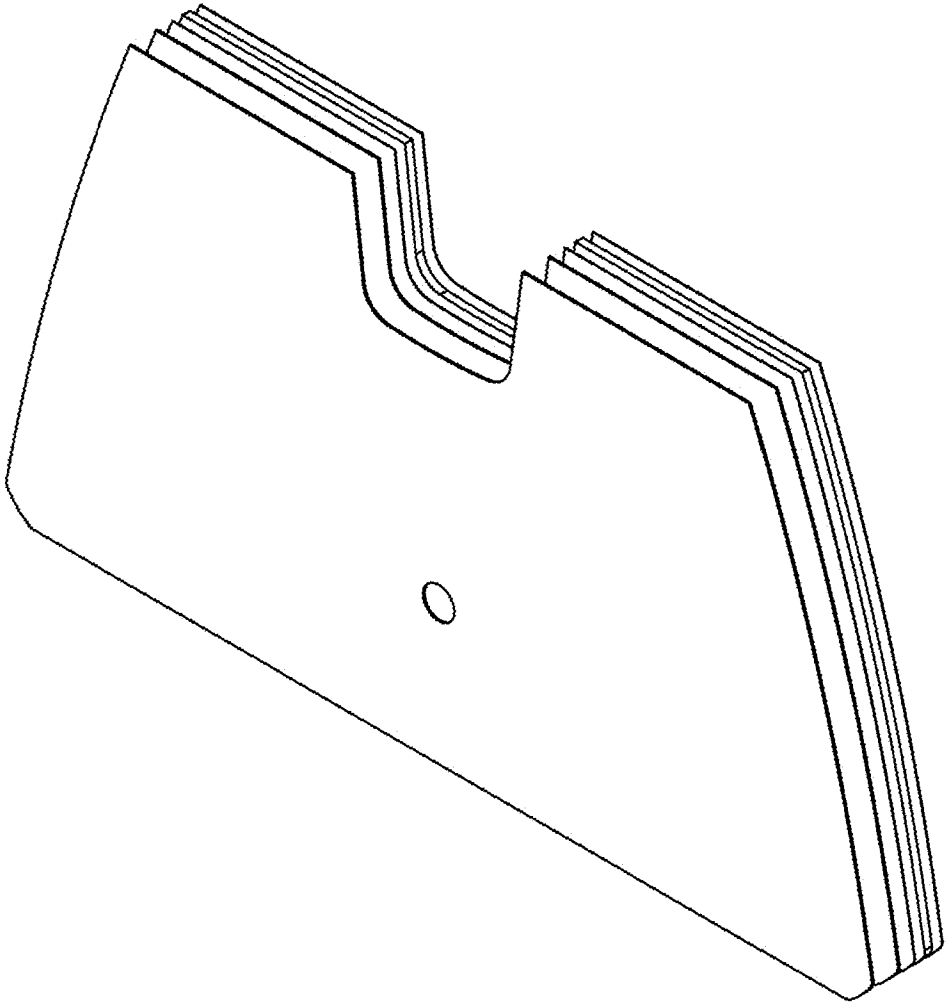
FIG. 8 is a simplified isometric expanded view diagram of a covering article according to an example of the present invention.

FIG. 8 is a simplified isometric expanded view diagram of a covering article according to an example of the present invention. As shown is the right view diagram of the covering article with the sheet of laminated material in expanded form.

Figure 9:
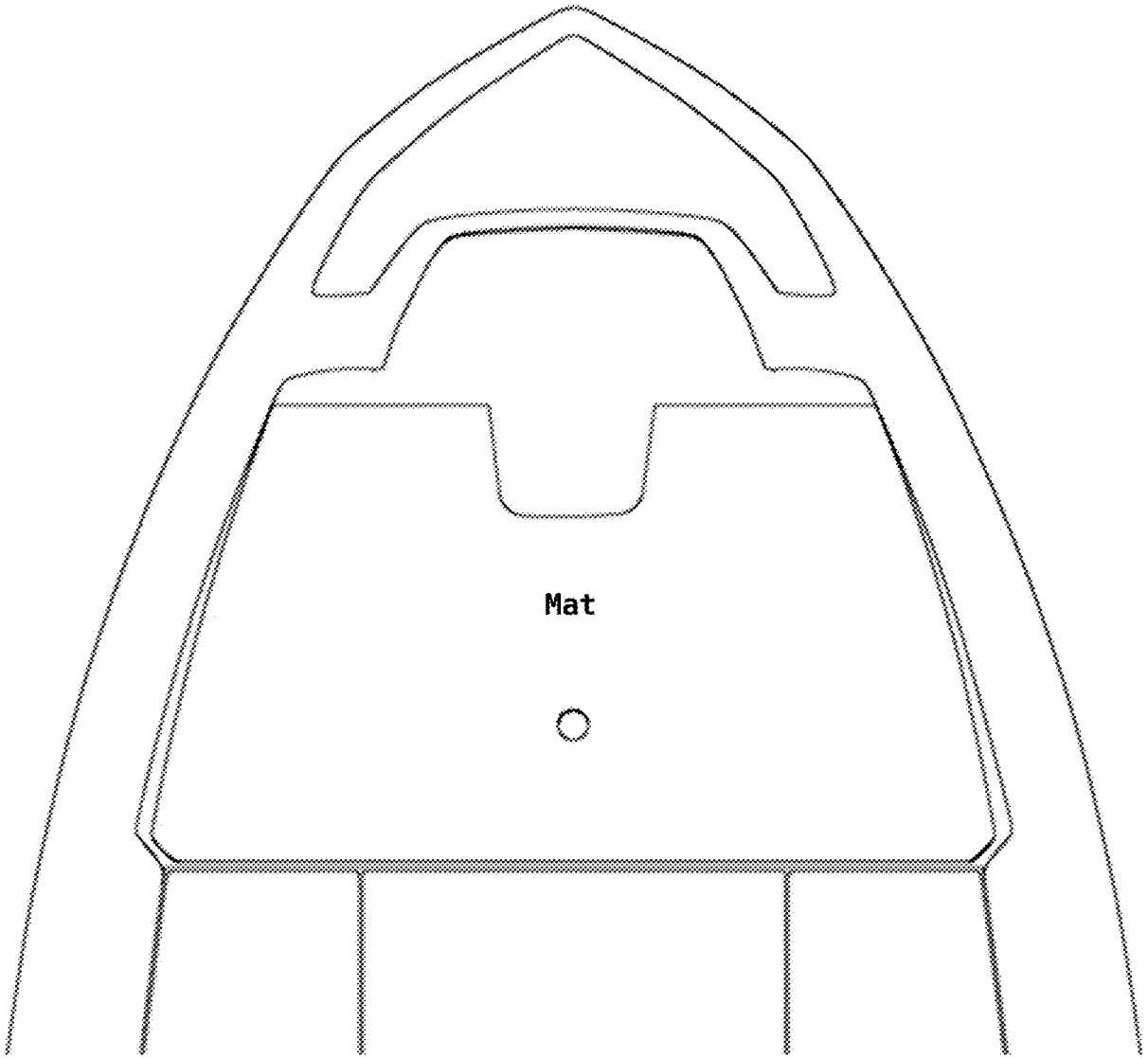
FIGS. 9 and 10 are simplified top-view diagrams of a covering article installed on a deck of a bass boat.
Figure 10:
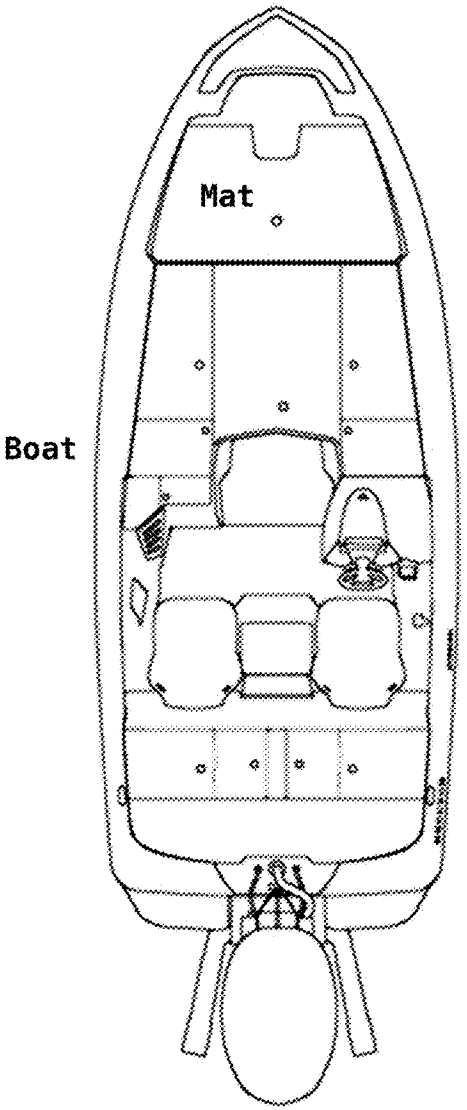

FIGS. 9 and 10 are simplified top-view diagrams of a covering article installed on a deck of a bass boat. In an example, the covering article is applied to an upper surface region of a bass boat. The entirety of the exposed surface deck can be fitted with the covering article for both protection and structural support.

Figure 11:
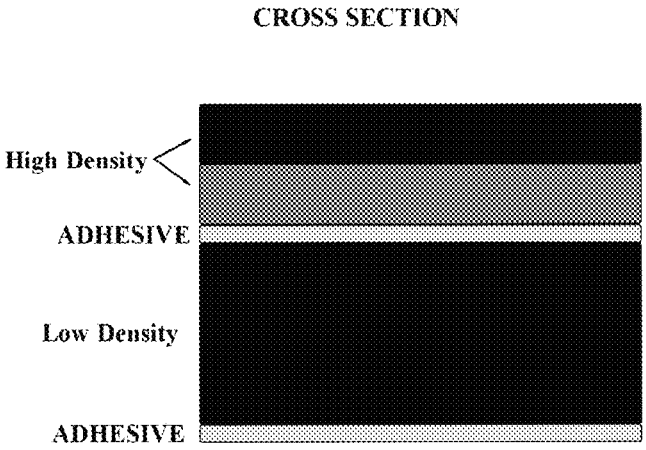
FIG. 11 is a simplified cross-sectional view diagram of a covering article according to an example of the present invention.

FIG. 11 is a simplified cross-sectional view diagram of a covering article according to an example of the present invention. As shown, the diagram shows an anti-fatigue covering article for a bass boat. In an example, the article has a sheet of EVA laminated material. In an example, the article has a first sheet of Ethylene Vinyl Acetate (EVA) foam material having a first surface region and a second surface region opposing the first surface region and a thickness sandwiched between the first surface region and the second surface region.

In an example, the first sheet of EVA foam material has a gray color, among others.

In an example, the article has a second sheet of EVA foam material having a first surface region and a second surface region opposing the first surface region and a thickness sandwiched between the first surface region and the second surface region.

Preferably, the second sheet of EVA foam material has a coloring selected from any combination of red, green, and blue or black. As will be shown, the coloring can be seen through the first sheet by a user to highlight the colors of the bass boat.

In an example, the article has an adhesive material configured to bond the first surface region of the first sheet of EVA foam material with the first surface region of the second EVA foam material using the adhesive material (e.g., 3M adhesive 3M-9775WL) between the first surface region of the first sheet of EVA foam material and the second surface region of the second EVA foam material.

In an example, the article has a second sheet of laminated material comprising a third sheet of closed cell foam (e.g., Part #VEVA3B) having a first side and a second side, the first side having an overlying adhesive material (e.g., Avery Dennison adhesive Part No. FT 1126-Covering and can peel off a covering).

In an example, the third sheet of closed cell foam being characterized by a second density that is lower in value than the first density, and optionally, characterized by a black color. In an example, an adhesive material is configured via bonding the second side of the third sheet of closed cell foam to a first surface region of first laminated EVA material using the adhesive material (e.g., 3M adhesive 3M-9775WL) applied to the second side of the third sheet of the closed cell foam.

Preferably, the sheet of second laminated material characterized by the lower density third sheet of closed cell foam as a bottom region and the first sheet of EVA material as an upper region such that the color of the second sheet of EVA material is visible from the upper region.

In an example, the second sheet of laminated material is shaped for customization to the spatial region of the bass boat or other vessel.

In an example, the bottom region comprises an adhesive backing with a covering to protect the adhesive backing.

In an example, the first sheet of EVA material has a thickness of three milli-meters and the second sheet of EVA material has a thickness of three millimeters.

In an example, the second laminated material is operable within a temperature range from 20 Degrees Fahrenheit to 110 (or 120) Degrees Fahrenheit; and is capable of gripping when subjected to moisture or water.

In a preferred example, the second laminated material is essentially continuous from an outer surface region through the thickness including the lower density foam and the higher density foam, and is free from an interface that could be de-bonded or de-laminated accidentally.

In an example, the second laminated material is capable of gripping a bottom of a foot or shoe while the upper region is subject to moisture or water.

In an example, the sheet of second laminated material is operable in a temperature ranging from, e.g., 20 Degrees Fahrenheit to 110 (or 120) Degrees Fahrenheit.

In an example, the higher density material is an ethylene-vinyl acetate (EVA)-based foam composed of approximately 60% EVA, 20% low-density polyethylene (LDPE), and 20% calcium carbonate (i.e., $CaCO_3$). The formulation combines the flexibility and resilience of EVA with the structural contribution of LDPE and the filler properties of calcium carbonate, resulting in a balanced foam material suitable for applications requiring durability, dimensional stability, and controlled cost.

In an example, the high-density material exhibits a nominal density of 0.01 $lb/in^3$ as determined in accordance with ASTM D3574, Test A. Hardness testing indicates a Shore C value of 75, reflecting a rigid structure with enhanced load-bearing capability. Preferably, water absorption performance, evaluated using ASTM D3575-08, demonstrates minimal moisture uptake, with measured absorption less than 0.002 $g/cm^3$. The properties collectively indicate a material well suited for applications requiring high density, structural durability, and strong resistance to water ingress.

In an example, the lower density material is a closed-cell, chemically crosslinked polyethylene foam. In an example, the material exhibits a nominal density of approximately 3 $lb/ft^3$ (48 $kg/m^3$), as measured in accordance with ASTM D3575, Suffix W. Hardness testing conducted per ASTM D2240 indicates a Shore 00 durometer value of 58, reflecting a balance between cushioning and structural support.

In an example, compression deflection testing, performed under ASTM D3575, Suffix D, shows a compressive stress of 10.5 psi (54 kPa) at 25% deflection and 19.8 psi (71 kPa) at 50% deflection. These values indicate consistent load-bearing performance across moderate compression levels. Compression set resistance, measured according to ASTM D3575, Suffix B, demonstrates a maximum compression set of 32% after 30 minutes at 50% compression and 13% after 24 hours, indicating good recovery characteristics over time.

In an example, mechanical strength testing reveals a tensile strength of 70.4 psi (485 kPa) as determined by ASTM D3575, Suffix T, with an elongation at break of approximately 319%, indicating substantial flexibility prior to failure. Tear resistance, evaluated under ASTM. D3575, Suffix G, measures 17.7 lbf/in (3.10 N/mm), supporting the material's durability under mechanical stress.

In an example, the foam maintains functional performance across a wide operating temperature range, from −94° F. to 194° F. (−70° C. to 90° C.). Water absorption testing conducted over a seven-day period in accordance with DIN 53428 shows a maximum volumetric absorption of 1%, confirming the material's closed-cell structure and resistance to moisture uptake. Thermal stability testing per ASTM D3575, Suffix S, demonstrates a maximum dimensional change of 2% after 24 hours at 158° F. (70° C.).

In an example, flammability testing conducted in compliance with FMVSS 302 indicates that the material meets the required burn rate limits for thicknesses greater than ¼ inch, passing both the 4 in/min and 100 mm/min criteria.

In an example, all testing was performed in accordance with applicable ASTM, DIN, and FMVSS standards, including ASTM D2240, ASTM D3575 (Suffixes B, D, G, S, T, and W), DIN 53428, and FMVSS 302.

In an example, the present adhesive is preferably the 3M 9775WL product that is a pressure-sensitive adhesive transfer tape manufactured by 3M, commonly used for permanent bonding applications across a variety of substrates such as foams, plastics, wood, fabrics, and textiles. In an example, the adhesive tape is particularly suited for industrial uses like bonding foam gaskets, textured or rough surfaces, and fabric lamination. In an example, the product features 3M™ Adhesive 300MP, a high-tack acrylic adhesive that flows into crevices and surface irregularities without the need for heat, enabling strong initial tack and achieving full adhesion within approximately 48-72 hours after application. In an example, the adhesive layer on 3M 9775WL is typically about 5 mils (0.13 mm) thick and is supported by a 96 pound white poly-coated kraft paper liner, which aids in handling, die-cutting, and converting processes. Designed for durability, the tape exhibits good resistance to humidity, solvents, chemicals, and UV exposure, and performs reliably across a broad temperature range (often up to about 250° F./121° C. in service). In use, the tape is applied by placing the adhesive side against the target substrate and removing the liner, leaving a pressure-sensitive, conformable bond useful for manufacturing and assembly processes where clean, permanent adhesion is required.

In a preferred example, each of the sheets of EVA foam material and/or closed cell foam is subjected to a drying process. The drying process removes any residual moisture that may be trapped in the foam material. In an example, the drying process subjects the foam material in a dry environment in a heat for a time period of a minimum of 1620 minutes @ a minimum of 300 degrees F. to remove any residual moisture from the foam material. By way of the dry foam material, the subsequent steps of bonding them together occurs more efficiently and reliably.

In an example, the present invention provides a bass boat platform having an anti-fatigue covering article. The bass boat platform comprises a bass boat comprising a deck region for fishing, the deck region having an exposed surface region. In an example, the system has a sheet of laminated material forming a covering overlying the exposed surface. In an example the sheet of laminated material comprises a first sheet of Ethylene Vinyl Acetate (EVA) foam material having a first surface region and a second surface region opposing the first surface region and a thickness of material sandwiched between the first surface region and the second surface region, the first sheet of EVA foam material having a gray color, a second sheet of EVA foam material having a first surface region and a second surface region opposing the first surface region and a thickness of material sandwiched between the first surface region and the second surface region, a coloring characterizing the second sheet of EVA foam material having a color selected from any combination of at least one of red, green, and blue, and an adhesive material configured to bond the first surface region of the first sheet of EVA foam material with the first surface region of the second EVA foam material using the adhesive material between the first surface region of the first sheet of EVA foam material and the second surface region of the second EVA foam material to form a first sheet of laminated EVA foam material. In an example, the system has a first sheet of closed cell foam having a first side and a second side, the first side having an overlying adhesive material, the first sheet of closed cell foam being characterized by a second density that is lower in value than the first density and characterized by a black color and the adhesive material configured via bonding the second side of the first sheet of closed cell foam to a first surface region of the first sheet of laminated EVA foam material using the adhesive material applied to the second side of the third sheet of the closed cell foam. In an example, the coloring of the second sheet of EVA material is visible from an upper region whereupon the sheet of laminated EVA foam material characterized by the lower density than the sheet of closed cell foam as a bottom region and the first sheet of EVA material as an upper region such that the color of the second sheet of EVA material is visible from the upper region through the first sheet of EVA material. Preferably, the system has a peelable adhesive material comprising an Avery Denison adhesive FT1126 configured with a peelable cover that has been removed coupling the second sheet of aminated material to the exposed surface region to attach the sheet of laminated material to the deck region.

Having described various embodiments, examples, and implementations, it should be apparent to those skilled in the relevant art that the foregoing is illustrative only and not limiting, having been presented by way of example only. Many other schemes for distributing functions among the various functional elements of the illustrated embodiment or example are possible. The functions of any element may be carried out in various ways in alternative embodiments or examples.

Also, the functions of several elements may, in alternative embodiments or examples, be carried out by fewer, or a single, element. Similarly, in some embodiments, any functional element may perform fewer, or different, operations than those described with respect to the illustrated embodiment or example. Also, functional elements shown as distinct for purposes of illustration may be incorporated within other functional elements in a particular implementation. Also, the sequencing of functions or portions of functions generally may be altered. In other examples, combinations or sub-combinations of the above disclosed invention can be advantageously made. The diagrams of the materials, architecture, and flow charts are grouped for ease of understanding. However, it should be understood that combinations of materials, additions of new layers, re-arrangement of layers, and the like are contemplated in alternative embodiments of the present invention.

The specification and drawings are, accordingly, to be regarded in an illustrative rather than a restrictive sense. It will, however, be evident that various modifications and changes may be made thereunto without departing from the broader spirit and scope of the invention as set forth in the claims.

The invention claimed is:

1. A method for manufacturing an anti-fatigue surface for a bass boat, the method comprising:

providing a first sheet of Ethylene Vinyl Acetate (EVA) foam material having a first surface region and a second surface region opposing the first surface region and a thickness sandwiched between the first surface region and the second surface region, the first sheet of EVA foam material having a gray color;

providing a second sheet of EVA foam material having a first surface region and a second surface region opposing the first surface region and a thickness sandwiched between the first surface region and the second surface region, the second sheet of EVA foam material having a color selected from any combination of red, green, blue, or black;

coupling the first sheet of EVA foam material with the second sheet of EVA foam material by bonding the first surface region of the first sheet of EVA foam material with the first surface region of the second EVA foam material using an acrylic adhesive material between the first surface region of the first sheet of EVA foam material and the second surface region of the second EVA foam material;

subjecting the first sheet of EVA foam material and the second sheet of EVA foam material with a pressure ranging from 50-150 Kpa to form a sheet of laminated EVA material comprising the first thickness of foam material and eth second thickness of foam material such that the sheet of laminated EVA material is characterized by a first density;

providing a third sheet of closed cell foam having a first side and a second side, the first side having an overlying adhesive material, the third sheet of closed cell foam being characterized by a second density that is lower in value than the first density and characterized by a black color;

bonding the second side of the third sheet of closed cell foam to a first surface region of first laminated EVA material using the acrylic adhesive material applied to the second side of the third sheet of the closed cell foam;

outputting a second sheet laminated material comprising the third sheet of closed cell foam and the sheet of laminated EVA material such that the second sheet of EVA foam material is sandwiched between the first sheet of EVA foam material and the third sheet of closed cell foam;

subjecting the second sheet of laminated material to a temperature ranging from 160 Celsius to 170 Celsius for between 1890 and 2310 minutes to cure the acrylic adhesive material in the second laminated material; and outputting the sheet of second laminated material characterized by the lower density third sheet of closed cell foam as a bottom region and the first sheet of EVA material as an upper region such that the color of the second sheet of EVA material is visible from the upper region.

2. The method of claim 1 further comprising retrieving an image of a spatial region of a deck of a boat and shaping the second sheet of laminated material using a laser cutting or mechanical cutting process for customization to the spatial region of the bass boat.

3. The method of claim 2 further comprising cleaning a surface region of an entirety of a deck of the bass boat.

4. The method of claim 2 further comprising cleaning a surface region of an entirety of a deck of a bass boat using a vacuum cleaner and a surfactant to remove debris from a carpet of the bass boat.

5. The method of claim 1 further comprising coupling a sheet of peelable adhesive on the bottom region of the second laminate material and peeling an adhesive backing of the adhesive material on the bottom region of the second laminated material; applying the second laminated material to a carpet of a spatial region of the bass boat, using the bass boat for at least a year of service, and peeling off the second laminated material from the carpet leaving the carpet free from residue.

6. The method of claim 5 further comprising subjecting the upper region of the second sheet of laminated using a roller to apply force to the second sheet of laminated material to bond the second sheet of laminated material to the surface region of the deck of the bass boat.

7. The method of claim 1 wherein the first sheet of EVA material has a thickness of three milli-meters and the second sheet of EVA material has a thickness of three millimeters.

8. The method of claim 1 wherein the first density is greater than the second density.

9. The method of claim 1 wherein the second laminated material is operable within a temperature range from 20 Degrees Fahrenheit to 120 Degrees Fahrenheit; and is capable of gripping a bottom of a user's feet, shoe, or sandal when subjected to moisture or water.

10. The method of claim 1 wherein the second laminated material is capable of gripping a bottom of a foot or shoe while the upper region is subject to moisture or water.

11. The method of claim 1 wherein the sheet of second laminated material is operable in a temperature ranging from 20 Degrees Fahrenheit to 120 Degrees Fahrenheit.

12. The method of claim 1 further comprising drying the first sheet of EVA foam material using a dryer; and drying the second sheet of EVA foam material using a dryer before coupling the first sheet of EVA foam material to the second sheet of EVA foam material.

* * * * *